US005106274A

United States Patent [19]

Holtzapple

[11] Patent Number: 5,106,274

[45] Date of Patent: Apr. 21, 1992

[54] HERMETIC COMPRESSOR

[76] Inventor: Mark Holtzapple, 1805 Southwood Dr., College Station, Tex. 77840

[21] Appl. No.: 556,261

[22] Filed: Jul. 23, 1990

[51] Int. Cl.[5] ..... F04B 9/08; F04B 35/04

[52] U.S. Cl. ..... 417/388; 417/383; 417/418

[58] Field of Search ..... 417/417, 418, 383, 384, 417/385, 386, 387, 388

[56] References Cited

U.S. PATENT DOCUMENTS

| | | | |
|---|---|---|---|
| 2,753,805 | 7/1956 | Boivinet | 417/383 |
| 2,827,853 | 3/1958 | Bradley | 417/383 |
| 3,030,892 | 4/1962 | Piccardo | 417/384 |
| 3,433,161 | 3/1969 | Vetter | 417/388 |
| 3,513,659 | 5/1970 | Martini | 417/383 |
| 3,680,981 | 8/1972 | Wagner | 417/388 |
| 3,740,171 | 6/1973 | Farhos | 417/418 |
| 3,754,154 | 8/1973 | Massie | 92/13.5 |
| 3,781,140 | 12/1973 | Gladden | 417/417 |
| 3,791,770 | 2/1974 | Farkos | 417/418 |
| 3,884,125 | 5/1975 | Massie | 310/30 |
| 4,047,850 | 9/1977 | Berthelot | 417/383 |
| 4,353,220 | 10/1982 | Curwen et al. | 62/228 |
| 4,365,942 | 12/1982 | Schmidt | 417/412 |
| 4,482,346 | 11/1984 | Reinicke | 417/417 |
| 4,545,209 | 10/1985 | Young | 417/417 |
| 4,750,871 | 6/1988 | Curwen | 417/416 |
| 4,830,588 | 5/1989 | Zentner | 417/460 |
| 4,883,412 | 11/1989 | Malizard et al. | 417/387 |

FOREIGN PATENT DOCUMENTS

| | | | |
|---|---|---|---|
| 3151764 | 9/1982 | Fed. Rep. of Germany | 417/388 |

OTHER PUBLICATIONS

"Pilot-Scale Diaphragm-Type Gas Compressors".

Mark Holtzapple, "Conceptual Design of an Ammonia Synthesizer for Space Applications", SAE The Engineering Society for Advancing Mobility Land Sea Air and Space, 1989, SAE Technical Paper Series 891589, pp. 1-11.

*Primary Examiner*—Richard A. Bertsch
*Assistant Examiner*—Peter Korytnyk
*Attorney, Agent, or Firm*—Cushman, Darby & Cushman

[57] ABSTRACT

A high-pressure hermetic compressor suitable for use in a zero-gravity environment. The compressor includes a solenoid, driven by a power supply, which causes a plunger to reciprocate in an internal space filled with hydraulic fluid. Such motion pressurizes the hydraulic fluid causing a diaphragm to distort. The deformation of the diaphragm compresses fluid in a compression chamber.

27 Claims, 1 Drawing Sheet

HERMETIC COMPRESSOR

BACKGROUND OF THE INVENTION

1. Field of the Invention

The present invention relates to compressors having a hermetic design and being capable of generating high pressures. In particular, the present invention relates to high-pressure compressors that are suitable for use in a zero-gravity environment.

2. Description of the Related Art

There are many types of compressors in use today, but few can be used in a zero-gravity environment. The closest known prior art are compressors commercially available from AMINCO of Silver Spring, Md. The AMINCO compressors use a diaphragm as the compressing element to produce a minimum of dead space inside the compressor. A plunger in the compression head reciprocates to compress hydraulic fluid which, in turn, pulses the diaphragm. The fluid to be compressed is taken in and discharged through check valves in the head plate on the down and up stroke of the diaphragm. The plunger is driven by a rotary electric motor coupled to a crank mechanism that produces linear motion. An interior chamber of the compressor body of the AMINCO model is filled with hydraulic fluid and air which is unsuitable for a zero gravity environment as the two phases do not orient properly. The AMINCO compressor also requires an excessive amount of maintenance due to the use of packing material in its design.

U.S. Pat. No. 4,488,856 to Preble et al. discloses a hermetically sealed hydraulic power supply having an oil reservoir with a pump for pumping oil from the reservoir that is driven by a gas turbine. This design features an oil reservoir containing the oil that is to be pumped. Further, the pump mechanism taught by Preble is a centrifugal pump rather than a positive displacement piston pump.

SUMMARY OF THE INVENTION

The hermetic compressor according to the present invention includes a housing defining a first interior space, at least one second interior space, at least one connecting passage between the first interior space and each second interior space and inlet and outlet passages. A diaphragm extends across each second interior space and divides each second interior space into a compression space and a hydraulic space. Each connecting passage is connected to a corresponding hydraulic space and the inlet and outlet passages are connected to each compression space. Hydraulic fluid fills each hydraulic space and the corresponding connecting passage. A piston is slidably disposed in each connecting passage for pressurizing the hydraulic fluid in each hydraulic space. A solenoid is positioned in the first interior space and is coupled to each piston so as to drive the piston and periodically pressurize the hydraulic fluid. Check valves are provided in the inlet and outlet passages to conduct unpressurized fluid through each inlet passage and for conducting pressurized fluid from each compression space through each outlet passage.

The present invention can operate with a high compression ratio and produce high-pressure fluid from low-pressure fluid in a single step. The compressor has a very low dead volume, a factor for achieving high compression ratios. High compression ratios are achieved utilizing a diaphragm that conforms to the head and sweeps out all the fluid except that in the check valve connecting tubes.

Pressures as high as 4000 atm can be produced utilizing the compressor according to the present invention. The compressor pressure is ultimately caused by the force of the electric field pushing against the solenoid plunger. If the plunger is large, then accordingly the electric field must be large thereby requiring an excessive number of coils, thus adding to the compressor's weight. In order to avoid this, a small-diameter plunger may be employed in the present invention that uses a larger stroke to obtain the same pumping volume.

A further advantageous feature of the present invention concerns the simplicity of construction The small number of parts needed to construct/manufacture the compressor according to the present invention allows for simplicity, low cost of fabrication, enhanced reliability and reduced weight. Also, the lack of appreciable sideloads contributes to the reduced wear in the present invention.

The present invention also successfully overcomes the problem of contaminating the pumped fluid inherent in previous compressors. Existing compressors have the compressed fluid directly contacting the oscillating piston. Often, such fluids such as water or air, do not lubricate, thereby enhancing piston wear and generating metal particles that contaminate the output compressed fluid. The present invention overcomes this difficulty by using a metal diaphragm to isolate the compressed fluid from the piston and by totally immersing the piston and plunger in lubricating hydraulic fluid.

A further advantage of the present invention is overpressure protection. That is, the present invention includes a pressure relief valve on the lubricating oil to limit the pressure output of the compressor. If the discharge pressure is too large, the system downstream from the compressor could be damaged.

A key goal of the present invention is to have a compressor suitable for applications in a zero-gravity environment. This is achieved by completely filling the interior of the compressor with hydraulic fluid. The present invention successfully avoids the problem of thermal expansion of the hydraulic fluid by utilizing a bellows that adjusts to volumetric changes.

BRIEF DESCRIPTION OF THE DRAWING

Other objects, features and characteristics of the present invention, as well as the methods of operation and functions of the related elements of the structure will become apparent upon considering the following detailed description of the preferred embodiments of this invention and appended claims with reference to the accompanying drawings in which:

DETAILED DESCRIPTION OF THE PRESENTLY PREFERRED EXEMPLARY EMBODIMENT

Figure 1:
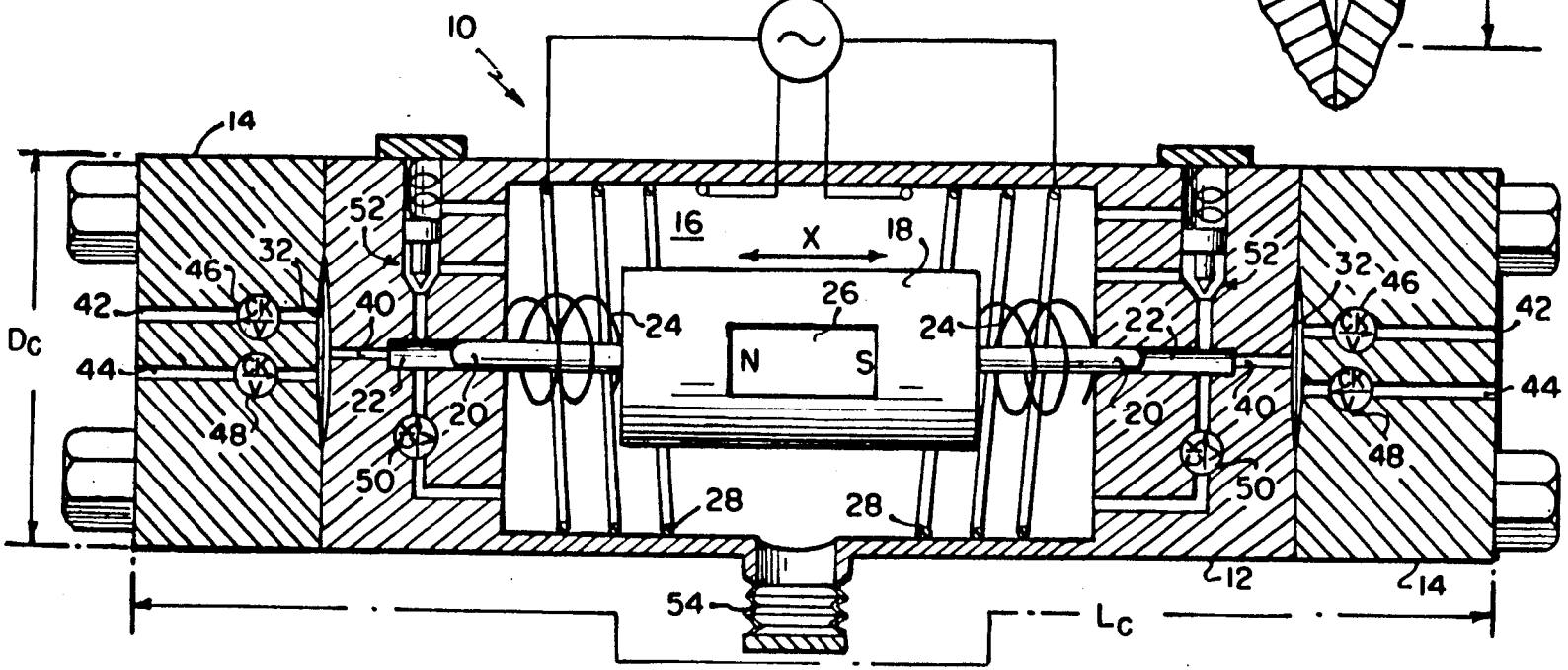
FIG. 1 is a cross sectional view of a compressor according to the present invention.

FIG. 1 illustrates the compressor according to the present invention shown in a cross sectional view. Such a compressor is well suited for applications in a zero-gravity environment.

The compressor, generally shown at 10 is a double acting compressor. Compressor 10 includes compressor body 12 and head plates 14 on opposite ends of body 12.

In this embodiment there are two head plates 14, but the compressor could operate with only one such plate.

Compressor body 12 has internal space 16 formed therein. Space 16 is completely filled with a hydraulic fluid. Plunger 18 is positioned in space 16 so as to allow it to oscillate in the direction indicated by arrow x. Plunger 18 is connected to pistons 20 that reciprocate in passages 22 formed in compressor body 12. Springs 24 provide the force necessary to center plunger 18. Plunger 18 is provided with an internal magnet 26 having a high field strength. Magnet 26 is made of, for example, neodymium or samarium/cobalt.

Plunger 18, magnet 26, springs 24 and pistons 20 make up a spring/mass system having a natural resonant frequency that will depend upon the mass of the system and the spring constant of springs 24. Solenoid coils 28, driven by an AC power supply 30, cause the spring-/mass system to oscillate. In order to maximize efficiency, it is desirable for the frequency of the power from supply 30 to match the resonant frequency of the spring/mass system. The energy needed to overcome viscous losses and compress the fluid is supplied by coils 28 and power supply 30.

The oscillation of plunger 18 and pistons 20 causes the deformation of diaphragms 32. Diaphragms 32 are made of stainless steel in the preferred embodiment, but may also be made out of a non-metal. Each diaphragm 32 is formed in space 34 formed between each head plate 14 and compressor body 12. A recess 36 is formed in each head plate 14 and a recess 38 is formed at each end of compressor body 12. When joined, recesses 36 and 38 form spaces 34. Both recesses are sinusoidal in shape. Passage 40 connects passage 22 with space 34. Passages 42 and 44 serve as outlets for the compressed fluid and inlets for the fluid to be compressed, respectively. Passages 42 and 44 have check valves 46 and 48, respectively, positioned therein to direct the fluid flow from and to compressor 10.

Since interior space 16 is completely filled with the relatively incompressible hydraulic fluid, temperature variations have the potential for generating large pressure swings within interior space 16. To prevent such pressure variations, bellows 54 is provided to expand when temperature increases and to contract when temperature decreases. In this manner, it is possible to maintain a constant pressure by allowing the volume to change via expansion and contraction of the bellows 54. Bellows 54 is usually made of material such as stainless steel. Bellows 54 may also be made of other metals or even rubber, so long as the bellows is not damaged by hydraulic fluid.

The compressor according to the present invention can output fluid pressurized up to 4000 atm. As the pressure of the fluid entering and exiting the compressor rises, i.e. high input and output pressure, it is necessary to have end plates 14 that are thicker in size.

AC power supply 30 has two sections of coils, as can be seen from FIG. 1, that simultaneously push and pull magnet 26. The AC power to coils 28 cause plunger 18 to oscillate, preferably at its natural resonant frequency. Movement of the plunger 18 forces pistons 20 to reciprocate in passages 22. This movement causes deformation of the diaphragm 32 and correspondingly pressurizes the fluid being compressed.

The swept volume of piston 20 is larger than the swept volume of diaphragm 32. When diaphragm 32 bottoms out against compressor body 12, a low pressure is created in passage 22 that draws hydraulic fluid in through check valve 50. When diaphragm 32 bottoms out against head plate 14, the pressure becomes high in passages 22 and is relieved through pressure relief valve 52.

Figure 2:
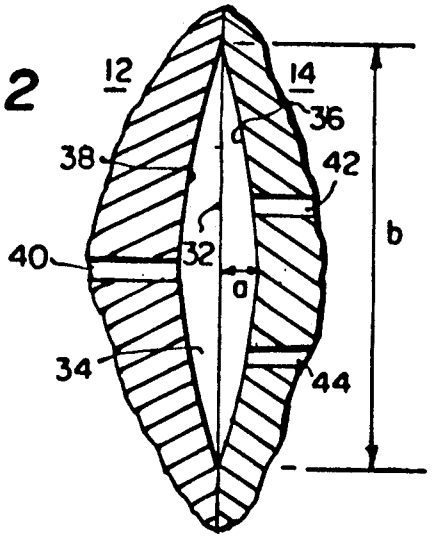
FIG. 2 is an enlargement of the diaphragm according to the present invention.

If the diaphragm diameter b, illustrated in FIG. 2 is known, the remaining dimensions of the compressor can be estimated. The length of the compressor, $L_c$ in FIG. 1, is about 7.5 times the diameter b of diaphragm 32. The diameter $D_c$ of compressor 10 is about twice the diameter b of diaphragm 32.

When pressure is applied to each diaphragm 32 via motion of plunger 18 and piston 20, diaphragm 32 is deformed so that it conforms to recesses 36 or 38. The shape of recesses 36 or 38 approximates the form of a sine wave, as mentioned above, having amplitude a. The area of the cross-section encompassed by the two sine wave recesses is denoted by $A_s$ and is represented by:

$$A_s = ab \tag{1}$$

and the volume of the sine wave recesses is $V_s$ shown by:

$$V_s = (\pi/6)\, ab^2. \tag{2}$$

$V_s$ is also known as the swept volume of the diaphragm. The ratio of $b/a \cong 27$, thus allowing the swept volume to be rewritten in terms of b as:

$$V_s = (\pi/162)\, b^3. \tag{3}$$

The mass flow rate of fluid, $\dot{m}$ which is compressed is given by the equation:

$$\dot{m} = n\, V_s \rho \eta \tag{4}$$

where n is the speed of the compressor, $\rho$ is the density of the fluid at the inlet and $\eta$ is the volumetric efficiency. The inlet fluid density can be estimated from the ideal gas equation $PV = RT$.

$$\rho = (P_1/RT)\, \overline{MW} \tag{5}$$

where $V = \overline{MW}/\rho$ and $\overline{MW}$ is the average molecular weight of the inlet fluid. T is temperature in degrees Kelvin and R is the ideal gas constant. $P_1$ indicates the input pressure of the fluid to be compressed.

The volumetric efficiency $\eta$ is shown by:

$$\eta = 1 - m\,((P_2/P_1) - 1), \tag{6}$$

$P_2$ being the outlet pressure of the compressed fluid on either side of compressor 10 from either check valve 46 through passage 42 and m being the ratio of clearance volume $V_c$ to swept volume $V_s$, or $$m = V_c/V_s. \tag{7}$$

The clearance volume concerns the volume of the inlet and outlet tubes, 44 and 42 respectively, between the recess 36 and check valves 46 and 48. This volume is also known as dead space.

The information necessary to solve for b is now available. So, solving for b one finds:

$$b = [162\dot{m}\, RT/(n\Delta P_1 \overline{MW}(1 - m((P_2 P_1) - 1)))]^{1/3} \tag{8}$$

For a given flow rate $\dot{m}$, the diaphragm diameter b is dependent upon the compressor speed n, the clearance ratio m and the compression ratio $P_2/P_1$.

The maximum compression ratio achievable is about 14:1 for each inlet and outlet of compressor 10. It is possible to couple a plurality of compressors 10 together in series (the output of each stage connected to the input of the next stage) to achieve compressions greater than 14:1. For example, if a gas at 1 atm is to be compressed to 4000 atm, four compressors would be needed, with each compressor having a compression ratio of at least 8:1.

It should also be noted that smaller compressor units have larger clearance ratios. This is due to the fact that clearance space, i.e. $V_c$, is very difficult to eliminate in smaller compressors.

The description provided above applies equally well to a compressor having only one inlet and one outlet. Such a compressor has only one diaphragm. Instead of having passage 22 formed in one of the walls of interior space 16, the wall can be solid. There would be no piston 20 on that side. Rather, spring 24 would be fixed to the wall of space 16 having no passage 22 formed therein.

While this invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. For example, it is possible that the compression ratio exceeds 14:1. Hence, one should realize that such modifications are entirely within the scope of the appended claims.

What is claimed is:

1. A hermetic compressor comprising:

a housing defining a first interior space, a second interior space, a connecting passage between the first and second interior spaces and inlet and outlet passages, said first interior space being completely filled with hydraulic fluid;

a diaphragm extending across said second interior space and dividing said second interior space into a compression space and a hydraulic space, said connecting passage being connected to said hydraulic space, and said inlet and outlet passages connected to said compression space, said hydraulic space and said connecting passage being filled with hydraulic fluid;

a piston slidably disposed in said connecting passage for pressurizing said hydraulic fluid in the hydraulic space;

a solenoid having a plunger disposed in the first interior space and coupled to said piston for driving said piston so as to periodically pressurize said hydraulic fluid;

means for conducting unpressurized fluid through said inlet passage and for conducting pressurized fluid from said compression space; and means, attached to said housing, for enabling volumetric variations due to thermal expansions of the hydraulic fluid.

2. A compressor as in claim 1, wherein said housing includes a compressor body and a head plate.

3. A compressor as claimed in claim 2, wherein said hydraulic space is formed by a recess in the compressor body and the compression space is formed by a recess in the head plate.

4. A compressor as in claim 3, wherein said recess in the compressor and said recess in the head plate are sinusoidal in shape.

5. A compressor as in claim 1, wherein said solenoid includes a magnet disposed in said plunger.

6. A compressor as in claim 5, wherein said solenoid further includes two coils that are disposed to respectively push and pull said magnet.

7. A compressor as in claim 1, wherein said hydraulic space and said compression space are sinusoidal in shape.

8. A compressor as in claim 1, wherein said hydraulic fluid completely fills said first interior space, said connecting passage and said hydraulic space.

9. A compressor as in claim 8, wherein said enabling means is a bellows fixed to said compressor body so as to communicate with said first interior space.

10. A compressor as in claim 1, wherein said means for conducting fluid through said inlet and outlet passages includes first and second check valves disposed in said inlet and outlet passages, respectively.

11. A compressor as in claim 1, further comprising an internal check valve and release valve, each communicating between said hydraulic space and said first interior space, for allowing low-pressure fluid to enter said hydraulic space and for allowing high-pressure fluid to exit said hydraulic space, respectively.

12. A compressor as in claim 1, further comprising springs disposed on opposite sides of the plunger for centering said plunger.

13. A hermetic compressor comprising:

a compressor body having a first interior space completely filled with hydraulic fluid, a first recess or an exterior wall, and a connecting passage between the first interior space and the first recess;

a head plate connected to the compressor body, said head plate having a second recess formed in a wall so that the second recess opposes the first recess in the body, said head plate having an inlet passage and an outlet passage, each connected to said second recess;

a diaphragm extending within a second interior space formed by the opposing first and second recesses, the diaphragm dividing the second interior space into a compression space and a hydraulic space, said connecting passage being connected to said hydraulic space and said inlet and outlet passages connected to said compression space, said hydraulic space and said connecting passage being filled with hydraulic fluid;

a piston slidably disposed in said connecting passage for pressurizing said hydraulic fluid in the hydraulic space;

a solenoid having an internal magnet disposed in the first interior space and coupled to said piston for periodically pressurizing said hydraulic fluid;

means for conducting unpressurized fluid through said inlet passage and for conducting pressurized fluid from said compression space; and means, attached to said housing, for enabling volumetric variations due to thermal expansions of the hydraulic fluid.

14. A compressor as in claim 13, wherein said enabling means is a bellows fixed to said compressor body so as to communicate with said first interior space.

15. A hermetic compressor comprising:

a housing having a first interior space, at least two second interior spaces and connecting passages extending form the first interior space to each of the second interior spaces;

a diaphragm dividing each said second interior space into a hydraulic space and a compression space, said interior space being connected with each of said hydraulic spaces via said connecting passages, said first interior space, connecting passages and hydraulic spaces being filled with hydraulic fluid;

pistons positioned in said connecting passages, respectively, for pressurizing hydraulic fluid filling said passages and said hydraulic spaces;

a solenoid having a plunger disposed in said first interior space and coupled to said pistons for driving said pistons to periodically pressurize said hydraulic fluid;

means for conducting unpressurized fluid to said compression space and for conducting pressurized fluid from said conducting space; and means, attached to said housing, for enabling volumetric variations due to thermal expansions of the hydraulic fluid.

16. A compressor as in claim 15, wherein the housing includes head plates and a compressor body, said head plates being disposed on opposite ends of the compressor body, said means for conducting being disposed within each of said head plates.

17. A compressor as in claim 15, wherein said plunger includes an internal magnet.

18. Apparatus as in claim 17, wherein said solenoid further includes two coils that are disposed to respectively push and pull said magnet.

19. A compressor as in claim 15 wherein said hydraulic fluid completely fills said first interior space, said connecting passages and said hydraulic spaces.

20. A compressor as in claim 15, wherein said enabling means is a bellows communicating with said interior space pressure variations of the hydraulic fluid in response to normal variations.

21. A compressor as in claim 18, further comprising an AC power supply for supplying a current to said coils to cause said plunger and said pistons to reciprocate.

22. A compressor as in claim 18, further comprising springs disposed on opposite sides of the plunger for centering said plunger.

23. A compressor as in claim 22, wherein said coils operate to drive said plunger at the natural resonant frequency of a system of said springs and said plunger.

24. Apparatus as in claim 15, wherein said recesses in said housing are sinusoidal in shape.

25. Apparatus as in claim 15, wherein said diaphragm has a diameter approximately equal to $$[162\dot{m}\ RT/(n\pi P_1 MW\ (1-m\ ((P_2/P_1)-1)))]^{1/3}$$

where $\dot{m}$ is the mass flow rate of the fluid, R is the ideal gas constant, T is temperature in degrees Kelvin, n is the compressor speed, $\overline{MW}$ is the average molecular weight, $P_1$ is the inlet pressure, $P_2$ is the desired outlet pressure and m is the clearance ratio.

26. A method of compressing fluid comprising the steps of:

energizing a solenoid so as to drive a plunger assembly located within a space interior to the compressor, said space being filled with a hydraulic fluid;

pressurizing said fluid by movement of a piston attached to said plunger;

deforming a diaphragm via said pressurized fluid thereby compressing fluid in a compression chamber, said diaphragm being located in a recess formed in a side of the compressor's body and a head plate attached thereto;

expelling the compressed fluid; and allowing a bellows to expand or contract in response to external temperature variations to thereby maintain a constant pressure of the hydraulic fluid within the space interior the compressor.

27. A method as in claim 26, wherein said solenoid drives said piston at its natural resonant frequency.

* * * * *